US007960324B2

(12) United States Patent
Le Coent et al.

(10) Patent No.: US 7,960,324 B2
(45) Date of Patent: Jun. 14, 2011

(54) ADDITIVE COMPOSITION HAVING LOW TEMPERATURE VISCOSITY CORROSION AND DETERGENT PROPERTIES

(75) Inventors: Jean-Louis Le Coent, Le Havre (FR); Amedee Guellec, St Sauveur d'Emalleville (FR)

(73) Assignee: Chevron Oronite Company LLC, San Ramon, CA (US)

( * ) Notice: Subject to any disclaimer, the term of this patent is extended or adjusted under 35 U.S.C. 154(b) by 1003 days.

(21) Appl. No.: 10/933,974

(22) Filed: Sep. 3, 2004

(65) Prior Publication Data

US 2006/0052259 A1 Mar. 9, 2006

(51) Int. Cl.
*C10M 159/22* (2006.01)
*C07C 37/66* (2006.01)
*C07C 51/15* (2006.01)

(52) U.S. Cl. ..... 508/460; 508/586; 508/518; 508/574; 508/539

(58) Field of Classification Search ..... 508/460, 508/586, 518, 574, 539
See application file for complete search history.

(56) References Cited

U.S. PATENT DOCUMENTS

| | | | |
|---|---|---|---|
| 3,036,971 | A | 5/1962 | Otto |
| 3,410,798 | A | 11/1968 | Cohen |
| 3,493,516 | A | 2/1970 | Allphin et al. |
| 5,035,816 | A | 7/1991 | Leone |
| 5,069,804 | A | 12/1991 | Marsh et al. |
| 5,433,871 | A | 7/1995 | O'Connor et al. |
| 5,451,331 | A | 9/1995 | O'Connor et al. |
| 5,714,443 | A | 2/1998 | Cane et al. |
| 5,716,914 | A | 2/1998 | Cane et al. |
| 6,162,770 | A | 12/2000 | Le Coent et al. |
| 6,262,001 | B1 | 7/2001 | Le Coent et al. |
| 6,291,408 | B1 | 9/2001 | Le Coent et al. |
| 6,348,438 | B1 | 2/2002 | Le Coent et al. |
| 2003/0195126 | A1 | 10/2003 | Boons |
| 2004/0235686 | A1 | 11/2004 | Boons et al. |

FOREIGN PATENT DOCUMENTS

| | | |
|---|---|---|
| EP | 0 094814 | 4/1989 |
| EP | 0351052 | 1/1990 |
| EP | 0385616 | 6/1994 |
| EP | 0351053 | 2/1995 |
| EP | 0 778 336 | 6/1997 |
| EP | 0347104 | 12/1997 |
| EP | 0347103 | 1/1998 |
| EP | 0 933 417 | 8/1999 |
| EP | 0 985 726 B1 | 11/2004 |
| JP | 2004346327 | 12/2004 |

*Primary Examiner* — Glenn A Caldarola
*Assistant Examiner* — Vishal Vasisth

(57) ABSTRACT

An additive composition providing improved low temperature viscosity, corrosion and detergent properties when used in lubricating oils for internal combustion engines is presented. The additive composition comprises an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

67 Claims, No Drawings

ADDITIVE COMPOSITION HAVING LOW TEMPERATURE VISCOSITY CORROSION AND DETERGENT PROPERTIES

The present invention relates to an additive composition for lubricating oils used in internal combustion engines. More particularly, the present invention relates to an additive composition containing an unsulfurized carboxylate detergent-dispersant additive having been modified by incorporation with an alkaline earth metal salt of a linear, saturated carboxylic acid. The additive composition of the present invention provides low temperature viscosity, corrosion and detergent properties when used in lubricating oils for internal combustion engines.

BACKGROUND OF THE INVENTION

The preparation of hydrocarbyl phenates and hydrocarbyl salicylates is well known in the art.

U.S. Pat. No. 3,036,971 discloses preparing detergent-dispersant additives based on sulfurized alkylphenates of high basicity alkaline earth metals. These additives are prepared by sulfurization of an alkylphenol, neutralization of the sulfurized alkylphenol with an alkaline earth metal base, then super-alkalization by carbonation of the alkaline earth metal base dispersed in the sulfurized alkylphenate.

U.S. Pat. No. 3,410,798 discloses basic metal salts of phenol or salicylic acid sulfides prepared by reacting a phenol or salicylic acid, or a slat thereof, with sulfur and an alkaline earth base at a temperature of about 150-200° C., in the presence of a carboxylic acid or salt thereof and a polyalkylene glycol or alkylene or polyalkylene glycol alkyl ether. The products are useful as detergent additives for lubricants.

U.S. Pat. No. 5,035,816 discloses a process for preparing alkylsalicylate superalkalinized detergent-dispersant lubricating oil additives: (a) by the acid catalyzed neutralization of $C_{12}$-$C_{30}$ alkylphenol with alkaline earth base in the presence of an azeotropic solvent for the water of reaction; (b) by the carboxylation of the first product with $CO_2$ to partially convert the alkylphenate to alkylsalicylate; and (c) by sulfurization-superalkalinization of the product in the presence of sulfur, alkaline earth base, azeotropic solvent and added $CO_2$ superalkalized detergent-dispersant additives based on alkylphenates and alkylsalicylates.

U.S. Pat. No. 6,291,408 discloses dispersant detergent additives for lubricating oils prepared by neutralization, carboxylation, sulfurization-overalkalinization, carbonation, distillation, filtering and degassing from alkyl phenols containing 35-85% by weight of linear alkyl substituents. The process does not require, during the neutralizing phase, the presence of a third solvent, which, by forming an azeotropic mixture with water promote the elimination of water arising from the neutralizing reaction. The additives of the invention have improved stability to hydrolysis and improved dispersion properties, improved compatibility and improved foaming properties.

U.S. Pat. Nos. 6,162,770 and 6,262,001 teach an unsulfurized, alkali metal-free, detergent-dispersant composition having from 40% to 60% alkylphenol, from 10% to 40% alkaline earth alkylphenate, and from 20% to 40% alkaline earth single-aromatic-ring alkylsalicylate, and a process for preparing the same. This composition may have an alkaline earth double-aromatic-ring alkylsalicylate as long as the mole ratio of single-ring alkylsalicylate to double-aromatic-ring alkylsalicylate is at least 8:1. This composition may be produced by the three-step process involving neutralization of alkylphenols, carboxylation of the resulting alkylphenate, and filtration of the product of the carboxylation step. The detergent-dispersant produced by the method can be used in an engine lubricating composition to improve antioxidant properties, high temperature deposit control, and black sludge control.

The addition of aliphatic carboxylic acids during the preparation of lubricating oil detergents is known. The resulting detergents can be referred to as carboxylic acid modified detergents and a variety of such detergents are known. The incorporation of aliphatic carboxylic acids into such detergents is known to modify their physical and/or performance properties. The most common physical modification observed by the incorporation of fatty acids into detergents, which is also the most common reason for performing this modification, is an increase in the TBN of the detergent without deleteriously increasing the viscosity of the product to an unacceptable level.

U.S. Pat. No. 3,493,516 discloses that the alkalinity value in the preparation of overbased phenates is enhanced by the addition of aliphatic carboxylic acids of from 1 to 6 carbon atoms to the reaction mixture during the preparation of the overbased alkyl phenate. Adding small amounts of low molecular weight carboxylic acids during the preparation of overbased alkylphenates, greater than 10 percent enhancements in the amount of calcium is obtained. The enhanced amount of calcium provides greater neutralization capability and superior protection in the engine against sludge formation. Despite the great enhancement in calcium content, the viscosity remains sufficiently low to provide a tractable product.

European Patent application No. 385,616 discloses the use of fatty acids in the production of overbased phenates from alkylphenols or phenates with increased TBN's and acceptable viscosity.

European Patent application No. 351,052 discloses the use of long chain carboxylic acids in the production of overbased salicylate detergents with TBN's greater than 300 and viscosity's less than 1000 cSt at 100° C.

European Patent application No. 347,104 discloses the use of long chain carboxylic acids to produce overbased carboxylic modified low overbased sulphonates and/or phenates and/or salicylate detergents with improved deposit forming properties.

European Patent application No. 347,103 discloses a process for producing carboxylic acid modified overbased phenates with TBN's greater than 300 and viscosities less than 1000 cSt at 100° C. starting from a phenate.

European Patent application No. 351,053 discloses the production of carboxylic acid modified overbased sulphonates with TBN's greater than 350 and viscosities less than 1000 cSt at 100° C. that have better filtration processing characteristics.

U.S. Pat. No. 5,716,914 discloses a process for producing a carboxylic acid modified overbased phenates with TBN's greater than 300 and viscosities less than 1000 cSt at 100° C.

U.S. Pat. No. 5,069,804 discloses improved stability of overbased phenates, particularly when formulated with overbased sulphonates, as well as improved foaming tendency and viscosity is obtained by treating the overbased phenate, either during or subsequent to the overbasing process, with from 0.1 to 10 wt %, preferably 2 to 6 wt %, of a carboxylic acid with a $C_{10}$ to $C_{24}$ unbranched segment, e.g. behenic acid.

U.S. Pat. No. 5,714,443 discloses an additive concentrate suitable for incorporation into a into a finished lubricating oil composition, the additive concentrate comprising: (a) a lubricating oil; (b) a lubricating oil soluble sulphurised alkaline earth metal hydrocarbyl phenate modified by incorporation of from greater than 2 to 35% by weight based on the weight of the composition of either (i) at least one carboxylic acid having formula (I), wherein R is $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the composition having a TBN greater than 300.

U.S. Pat. No. 5,433,871 discloses a process for the production of carboxylic acid modified overbased mixed detergents (phenate and/or salicylate and/or napthenate and/or sulfonate) with TBN's greater than 300 while retaining an acceptable viscosity.

U.S. Pat. No. 6,348,438 discloses an overbased alkaline earth metal single-aromatic ring hydrocarbyl salicylate-carboxylate is produced by overbasing a mixture of a single-aromatic ring hydrocarbyl salicylate, at least one solvent, a metal hydroxide, and an alkyl polyhydric alcohol alkaline earth metal hydroxide, by contacting that mixture with carbon dioxide under overbasing reaction conditions. The alkyl group of the alkyl polyhydric alcohol has from one to five carbon atoms. The overbased metal single-aromatic ring hydrocarbyl salicylate is treated, before, during, or subsequent to overbasing, with a long-chain carboxylic acid to form a single-aromatic ring hydrocarbyl salicylate-carboxylate.

SUMMARY OF THE INVENTION

The present invention relates to an additive composition for lubricating oils used in internal combustion engines. More particularly, the present invention relates to an additive composition that provides low temperature viscosity, corrosion and detergent properties when used in lubricating oils for internal combustion engines.

In its broadest aspect, the present invention relates to an additive composition comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

Preferably, the sediment value is less than 0.15%, more preferably less than 0.1% by volume.

Preferably, the unsulfurized carboxylate detergent-dispersant additive comprises:

a) Less than about 30 wt % hydrocarbyl phenol,
b) from about 10 wt % to 50 wt % alkaline earth metal hydrocarbyl phenate, and
c) from about 15 wt % to 60 wt % alkaline earth metal single aromatic-ring hydrocarbyl salicylate.

The hydrocarbyl group on the hydrocarbyl phenol, hydrocarbyl phenate and hydrocarbyl salicylate is independently derived from a linear olefin, an isomerized olefin, a branched chain olefin or a mixture thereof. The hydrocarbyl group is typically an alkyl group having from about 12 to 40, preferably from about 18 to 30 carbon atoms. The alkyl group is derived from an isomerized olefin. The alkyl group may be a branched alkyl group having at least 9, preferably from about 9 to 24, and more preferably from about 10 to 18, carbon atoms.

The alkaline earth metal of the alkaline earth metal hydrocarbyl phenate and the alkaline earth metal single aromatic-ring hydrocarbyl salicylate is independently selected from the group consisting of calcium, magnesium, barium or strontium. Preferably, the alkaline earth metal of the alkaline earth metal hydrocarbyl phenate and the alkaline earth metal single aromatic-ring hydrocarbyl salicylate is calcium.

The alkaline earth metal of the alkaline earth metal salt of the linear, saturated carboxylic acid is calcium. Preferably, the linear, saturated carboxylic acid is stearic acid. The preferred alkaline earth metal salt of the linear, saturated carboxylic acid is calcium stearate.

Typically, the alkaline earth metal salt of the linear, saturated carboxylic acid is present at a concentration of from about 3.2 wt % to 7.5 wt %, preferably from about 3.5 wt % to 7.0 wt %, and more preferably from about 4.0 wt % to 6.0 wt %, based on the total additive composition.

The present invention also relates to a lubricating oil composition comprising:

a) a major amount of base oil of lubricating viscosity; and
b) a minor amount of an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

In another embodiment, the present invention relates to a method for producing an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume. The method comprising:

a) neutralizing one or more hydrocarbyl phenols using an alkaline earth metal base to form an intermediate product,
b) carboxylating the intermediate product of a) using carbon dioxide so that at least about 5 wt % of the original hydrocarbyl phenol starting material has been converted to alkaline earth single aromatic-ring hydrocarbyl salicylate,
c) separating at least about 10 wt % of the starting hydrocarbyl phenols from the product obtained in b), and
d) adding an alkaline earth metal salt of a linear, saturated carboxylic acid having from about 16 to about 20 carbon atoms in the presence of a solvent selected from the group consisting of aromatic hydrocarbons, aliphatic hydrocarbons and monoalcohols to produce the unsulfurized carboxylate detergent-dispersant additive.

The present invention further relates to a product produced according to the method described above.

In still another embodiment, the present invention relates to a method of improving low temperature viscosity while maintaining corrosion and detergent properties of a lubricating oil composition in an internal combustion engine, said method comprising operating the internal combustion engine with a lubricating oil composition comprising:

a) a major amount of base oil of lubricating viscosity; and
b) a minor amount of an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

Preferably, the lubricating oil composition is a low emission diesel lubricant.

Among other aspects, the additive composition of the present invention has been found to be effective in improving the low temperature viscosity of lubricating oils when employed in internal combustion engines. In particular, the additive composition is preferably desirable in low emission diesel lubricants (LEDL) in low emission diesel engines equipped with exhaust gas after-treatment systems. Additional beneficial properties of the LEDL are the low levels of ash, sulfur, and phosphorus contents. Not only does the LEDL of the present invention provide improved low temperature properties, it also provides measurable improvement of corrosion and detergency properties when employed in low emission diesel engines.

DETAILED DESCRIPTION OF THE INVENTION

As mentioned previously, the present invention relates to an additive composition comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

Prior to discussing the present invention in detail, the following terms have the following meanings unless expressly stated to the contrary.

DEFINITIONS

The term "hydrocarbyl" means an alkyl or alkenyl group.

The term "alkali metal" or "alkaline metal" means lithium, sodium or potassium.

The term "metal" means alkali metals, alkaline earth metals, or mixtures thereof.

The term "alkaline earth metal" means calcium, barium, magnesium, strontium, or mixtures thereof.

The term "salicylate" means a metal salt of a salicylic acid.

The term "alkaline earth metal single-aromatic-ring hydrocarbyl salicylate" means an alkaline earth metal salt of a hydrocarbyl salicylic acid, wherein there is only one hydrocarbyl salicylic anion per each alkaline earth metal base cation.

The term "alkaline earth metal single-aromatic-ring alkylsalicylate" means an alkaline earth metal single-aromatic-ring hydrocarbyl salicylate wherein the hydrocarbyl group is an alkyl group.

The term "alkaline earth metal double-aromatic-ring hydrocarbyl salicylate" means an alkaline earth metal salt of a hydrocarbyl salicylic acid, wherein there are two hydrocarbyl salicylic anions per each alkaline earth metal base cation.

The term "alkaline earth metal double-aromatic-ring alkylsalicylate" means an alkaline earth metal double-aromatic-ring hydrocarbyl salicylate wherein the hydrocarbyl groups are alkyl groups.

The term "hydrocarbyl phenol" means a phenol having one or more hydrocarbyl substituents; at least one of which has a sufficient number of carbon atoms to impart oil solubility to the phenol.

The term "alkylphenol" means a phenol having one or more alkyl substituents, wherein at least one of the alkyl substituents has a sufficient number of carbon atoms to impart oil solubility to the phenol.

The term "phenate" means a metal salt of a phenol.

The term "hydrocarbyl phenate" means a metal salt of a hydrocarbyl phenol.

The term "alkaline earth metal hydrocarbyl phenate" means an alkaline earth metal salt of a hydrocarbyl phenol.

The term "isomerized" means a linear olefin that has been isomerized prior to alkylation of a phenol.

The term "linear, saturated carboxylic acid" means a carboxylic acid having a linear, saturated alkyl chain, wherein the average carbon number of the carboxylic acid is from about 16 to about 20.

The term "stearic acid" means a linear, saturated carboxylic acid, wherein the carbon number of the acid is predominately 18.

The term "unsulfurized" means containing less than 0.1 wt % sulfur.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

The term "carboxylate" refers to an alkaline earth metal single aromatic ring hydrocarbyl salicylate.

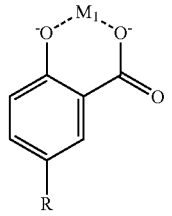

single aromatic ring hydrocarbyl salicylate wherein $M_1$ is an alkaline earth metal selected from the group consisting of barium, calcium, magnesium, and strontium

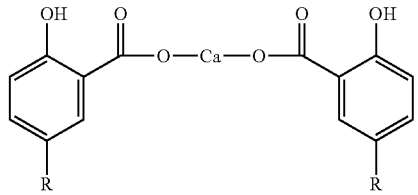

double aromatic ring hydrocarbyl salicylate

When the weight ratio of single aromatic ring hydrocarbyl salicylate divided by double aromatic ring hydrocarbyl salicylate is greater than 8:1, it is also called single aromatic ring hydrocarbyl salicylate.

Unless otherwise specified, all percentages are in weight percent (wt %).

Unsulfurized Carboxylate Detergent-Dispersant Additive

The additive composition of the present invention comprises an unsulfurized carboxylate detergent-dispersant additive as shown in Formula (I) below (also referred to herein as "carboxylate" or "carboxylated detergent").

Formula I

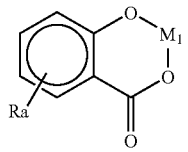

wherein $R_a$ is a linear hydrocarbyl group, branched hydrocarbyl group, or a mixture thereof. Preferably, $R_a$ is an alkenyl or alkyl group. More preferably, $R_a$ is an alkyl group. $M_1$ is an alkaline earth metal selected from the group consisting of barium, calcium, magnesium, and strontium. Calcium is preferred.

Level of Superalkalinization

The level of superalkalinization is the molar ratio of mineral calcium salt to organic calcium. The level of superalkalinization is preferably low because high soap content is desired in order to obtain good detergency properties. The level of superalkalinization takes into account:

- Mineral calcium salt is mainly calcium carbonate coming from the reaction of lime with carbon dioxide ($CO_2$)
- Calcium soap is mainly the calcium linked to a long alkyl chain (stearic, alkylphenol or single aromatic ring alkylcyclic)
- Calcium formiate, calcium acetate and calcium glycolate are in very low quantity, so they are not included in the determination of level of superalkalinization Typically, the level of superalkalinization is less than about 1.4:1, preferably less than about 1.2:1, more preferably less than about 1:1 and most preferably less than about 0.2:1.

The unsulfurized carboxylate detergent-dispersant additive may be prepared by the following process.

A. Neutralization Step

In the first step, alkylphenols are neutralized using an alkaline-earth metal base in the presence of at least one carboxylic acid that contains from about 1 to 4 carbon atoms, i.e., $C_1$ to $C_4$ as a promoter. This reaction is carried out in the absence of alkaline metal base, and in the absence of dialcohol or monoalcohol.

The hydrocarbyl group on the hydrocarbyl phenols may be derived from up to about 98 wt % linear olefin groups, up to about 98 wt % isomerized olefin groups, up to about 100 wt % branched chain olefin groups, or a mixture thereof. Preferably, the linear hydrocarbyl group is an alkyl group having from about 12 to 40 carbon atoms, more preferably from about 18 to 30 carbon atoms. The alkyl group may be derived from an isomerized olefin. The branched chain olefin group is an alkyl group having at least 9 carbon atoms, preferably from about 9 to 24 carbon atoms, more preferably from about 10 to 18 carbon atoms.

In one embodiment, the hydrocarbyl group of the hydrocarbyl phenols is derived from up to 85 wt % of linear olefin (preferably at least 35 wt % linear olefin) in mixture with at least 15 wt % of branched chain olefin.

The use of an alkylphenol containing up to at least 35 wt % of long chain linear alkylphenol, wherein the alkyl group has from about 18 to 30 carbon atoms, is particularly attractive because a long linear alkyl chain promotes the compatibility and solubility of the additives in lubricating oils. However, the presence of relatively long linear alkyl groups in the alkylphenols makes the latter less reactive than branched alkylphenols, hence the need to use harsher reaction conditions to bring about their neutralization by an alkaline-earth metal base. For example, linear olefins are marketed by Chevron Philips Company (CPC) under the names normal alpha olefin NAO $C_{26}$-$C_{28}$ or normal alpha olefin NAO $C_{20}$-$C_{24}$.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively reactive towards an alkaline-earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, meta, and para positions is much more uniformly distributed. This makes them much less reactive towards an alkaline-earth metal base since the phenol function is much less accessible due to considerable steric hindrance, due to the presence of closer and generally heavier alkyl substituents. Of course, linear alkylphenols may contain alkyl substituents with some branching, such as those marketed by the British Petroleum Company (BP) under the name BP Olefin $C_{20}$-$C_{26}$, which increases the amount of para substituents and, resultantly, increases the relative reactivity towards alkaline earth metal bases. One difference between CPC NAO $C_{20}$-$C_{24}$ and BP olefin $C_{20}$-$C_{26}$ is the level of alpha olefin (double bond at the end of alkyl chain) which is around 90% in CPC and in the range of 30% to 65% in BP which has some internal olefin. Another way to increase the reactivity of linear alpha olefin such as CPC $C_{20}$-$C_{24}$ and CPC $C_{20}$-$C_{28}$ is to isomerize them before the conversion into alkylphenols.

The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The promoter used in this step can be any material that enhances neutralization. For example, the promoter may be a polyhydric alcohol, ethylene glycol or any carboxylic acid. Preferably, a carboxylic acid is used. More preferably, $C_1$ to $C_4$ carboxylic acids are used in this step include formic, acetic, propionic and butyric acid, and may be used alone or in mixture. Preferably, a mixture of acids is used, most preferably a formic acid/acetic acid mixture. The molar ratio of formic acid/acetic acid should be from about 0.2:1 to 100:1, preferably from about 0.5:1 to 4:1, and most preferably about 1:1. The carboxylic acids act as transfer agents, assisting the transfer of the alkaline-earth metal bases from a mineral reagent to an organic reagent.

The neutralization operation is carried out at a temperature of at least 200° C., preferably at least 215° C., and, more preferably, at least 240° C. The pressure is reduced gradually below atmospheric in order to distill off the water of reaction. Accordingly, the neutralization should be conducted in the absence of any solvent that may form an azeotrope with water. Preferably, the pressure is reduced to no more than 7,000 Pa (70 mbars).

The quantities of reagents used should correspond to the following molar ratios:

(1) alkaline-earth metal base/alkylphenol from about 0.2:1 to 0.7:1, preferably from about 0.3:1 to 0.5:1; and (2) carboxylic acid/alkylphenol from about 0.01:1 to 0.5:1, preferably from about 0.03:1 to 0.15:1.

Preferably, at the end of this neutralization step the hydrocarbyl phenate obtained is kept for a period not exceeding fifteen hours at a temperature of at least 215° C. and at an absolute pressure from about 5,000 to $10^5$ Pa (between 0.05 and 1.0 bar). More preferably, at the end of this neutralization step the alkylphenate obtained is kept for between two and six hours at an absolute pressure from about 10,000 to 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

B. Carboxylation Step

The carboxylation step is conducted by simply bubbling carbon dioxide into the reaction medium originating from the preceding neutralization step and is continued until at least about 5 wt % of the starting alkylphenol has been converted to hydrocarbyl salicylate (measured as salicylic acid by potentiometric determination). It must take place under pressure in order to avoid any decarboxylation of the hydrocarbyl salicylate that forms.

Preferably, at least 22 mole %, of the starting alkylphenols is converted to alkylsalicylate using carbon dioxide at a temperature between 180° C. and 240° C., under a pressure within the range of from above atmospheric pressure to $15\times10^5$ Pa (15 bars) for a period of one to eight hours.

According to one variant, at least 25 mole % of the starting alkylphenols is converted to alkylsalicylate using carbon dioxide at a temperature equal to or greater than 200° C. under a pressure of $3.5\times10^5$ Pa (3.5 bars).

C. Filtration Step

The product of the carboxylation step may advantageously be filtered. The purpose of the filtration step is to remove sediments, and particularly crystalline calcium carbonate, which might have been formed during the preceding steps, and which may cause plugging of filters installed in lubricating oil circuits.

D. Separation Step of Hydrocarbyl Phenol

At least about 10 wt % of the hydrocarbyl phenol is separated from the product of the carboxylation step. Preferably, the separation is accomplished using distillation. More preferably, the distillation is carried out in a wiped film evaporator at a temperature of from about 150° C. to 270° C. and at a pressure of from about 0.1 to 4 mbar; more preferably from about 190° C. to 260° C. and at from about 0.5 to 3 mbar; most preferably from about 210° C. to 250° C. and at a pressure of from about 1 to 2 mbar. At least about 10 wt % of the hydrocarbyl phenol is separated. More preferably, at least about 30 wt % of the hydrocarbyl phenol is separated. Most preferably, up to about 55 wt % of the hydrocarbyl phenol is separated. The separated hydrocarbyl phenol may then be recycled to be used as starting materials in the present process or in other processes.

The unsulfurized carboxylated detergent-dispersant additive formed by this process can be characterized by its unique composition, with much more alkaline-earth metal single aromatic-ring hydrocarbyl salicylate and less alkylphenol than produced by other routes.

The reaction product (at the filtration step before separation step) will typically have the following composition:

a) Less than about 30 wt % hydrocarbyl phenol,
b) from about 10 wt % to 50 wt % alkaline-earth metal hydrocarbyl phenate, and
c) from about 15 wt % to 60 wt % alkaline-earth metal single aromatic-ring hydrocarbyl salicylate.

The preceding process is more fully described in U.S. Pat. No. 6,162,770, which is incorporated by reference into this application.

Unlike alkaline-earth metal hydrocarbyl salicylates produced by other processes, this unsulfurized carboxylate detergent-dispersant additive composition can be characterized by having only minor amounts of an alkaline-earth metal double aromatic-ring hydrocarbyl salicylate. The mole ratio of single aromatic-ring hydrocarbyl salicylate to double aromatic-ring hydrocarbyl salicylate is at least 8:1.

Preferably, the TBN of the unsulfurized carboxylate detergent-dispersant additive is less than about 200, preferably less than about 160 and more preferably less than about 140.

Characterization of the Unsulfurized Carboxylate Detergent-Dispersant Additive by Infrared Spectrometry Out-of-aromatic-ring-plane C—H bending vibrations were used to characterize the unsulfurized carboxylate detergent-dispersant additive of the present invention.

Infrared spectra of aromatic rings show strong out-of-plane C—H bending transmittance band in about the 675-870 $cm^{-1}$ region, the exact frequency depending upon the number and location of substituents. For ortho-disubstituted compounds, transmittance band occurs at about 735-770 $cm^{-1}$. For para-disubstituted compounds, transmittance band occurs at about 810-840 $cm^{-1}$.

Infrared spectra of reference chemical structures relevant to the present invention indicate that the out-of-plane C—H bending transmittance band occurs at about 750±3 $cm^{-1}$ for ortho-alkylphenols, at about 760±2 $cm^{-1}$ for salicylic acid, and at about 832±3 $cm^{-1}$ for para-alkylphenols.

Alkaline earth alkylphenates known in the art have infrared out-of-plane C—H bending transmittance bands at about 750±3 $cm^{-1}$ and at about 832±3 $cm^{-1}$. Alkaline earth alkylsalicylates known in the art have infrared out-of-plane C—H bending transmittance bands at about 763±3 $cm^{-1}$ and at about 832±3 $cm^{-1}$.

The unsulfurized carboxylate detergent-dispersant additive of the present invention shows essentially no out-of-plane C—H bending vibration at about 763±3 $cm^{-1}$, even though there is other evidence that alkylsalicylate is present. This particular characteristic has not been fully explained. However, it may be hypothesized that the particular structure of the single aromatic ring alkylsalicylate prevents in some way this out-of-plane C—H bending vibration. In this structure, the carboxylic acid function is engaged in a cyclic structure, and thus may generate increased steric hindrance in the vicinity of the aromatic ring, limiting the free motion of the neighbor hydrogen atom. This hypothesis is supported by the fact that the infrared spectrum of the acidified product (in which the carboxylic acid function is no longer engaged in a cyclic structure and thus can rotate) has an out-of-plane C—H transmittance band at about 763±3 $cm^{-1}$.

The unsulfurized carboxylate detergent-dispersant additive of the present invention can thus be characterized by having a ratio of infrared transmittance band of out-of-plane C—H bending at about 763±3 $cm^{-1}$ to out-of-plane C—H bending at about 832±3 $cm^{-1}$ of less than 0.1:1.

E. Treatment with Alkaline Earth Metal Salt of a Linear, Saturated Carboxylic Acid The additive composition of the present invention containing the unsulfurized carboxylate detergent-dispersant additive is preferably modified by incorporation of from about 3.2 wt % to 7.5 wt %, more preferably from about 3.5 wt % to 7.0 wt %, and most preferably from about 4.0 wt % to 6.0 wt %, based on the total additive composition, of an alkaline earth metal salt of a linear, saturated carboxylic acid having from about 16 to about 20 carbon atoms.

The alkaline earth metal of the alkaline earth metal salt of the linear, saturated carboxylic acid is selected from the group consisting of barium, calcium, magnesium and strontium. Calcium is the preferred alkaline earth metal. Preferably, the linear, saturated carboxylic acid is stearic acid (stearate), i.e., a long-chain carboxylic acid, wherein the carbon number of the acid is predominately 18, as commercially available from any number of manufacturers, e.g., ATOFINA under the name of STAVINOR CA90C. The preferred alkaline earth metal salt of the linear, saturated carboxylic acid is calcium stearate.

In one embodiment, dispersion of the alkaline earth metal stearate is done at a temperature between from about 80° C. to 250° C., preferably from about 120° C. to 200° C., and more preferably from about 150° C. to 180° C. A small quantity of solvent may be utilized to increase the rate of reaction. An unsulfurized carboxylate detergent-dispersant additive having been treated with an alkaline earth metal salt of stearic acid is obtained.

In a second embodiment, calcium stearate is generated "in situ". The first step, a premix is formed by reaction with stearic acid, alkaline earth metal base, diluent oil, a small quantity of $C_1$ to $C_4$ carboxylic acid as a promoter in the presence of a solvent selected from the group consisting of aromatic hydrocarbons, aliphatic hydrocarbons and monoalcohols at a temperature from about 100° C. to 140° C., preferably from about 110° C. to 130° C. Among the solvents that can be used are, for example, xylene, toluene, cyclohexane, 2-ethylhexanol, the oxo alcohols, decyl alcohol, tridecyl alcohol, 2-butoxyethanol, 2-butoxypropanol, methyl ether of propylene glycol. Monoalcohols with boiling points above 120° C. are preferred. A preferred monoalcohol is 2-ethylhexanol. The reaction was maintained between about 1 to 3 hours, then a small vacuum is applied to facilitate the elimination of water. This first step generates the calcium stearate.

Then the unsulfurized carboxylate detergent-dispersant additive obtained at the end of the separate step (step d) is added and the temperature is increased up to from about 150° C. to 200° C. and preferably from about 160° C. to 180° C. to incorporate the calcium stearate.

Solvent is removed from the medium preferably by distillation under vacuum. The sediment (unreacted alkaline earth metal base and stearate salt) is removed by filtration using a Buckner filtration apparatus. An additive composition is obtained comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

Lubricating Oil Composition

The present invention also relates to a lubricating oil composition containing the additive composition of the present invention. Such a lubricating oil composition will comprise a major amount of a base oil of lubricating viscosity and a minor amount of an additive composition comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

Base oil as used herein is defined as a base stock or blend of base stocks which is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 1000 Centigrade (C) and about 4 centistokes (cSt) to about 20 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100 C. Oils used as the base oil will be selected or blended depending on the desired end use and the additives in the finished oil to give the desired grade of engine oil, e.g. a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Saturates levels and viscosity indices for Group I, II and III base oils are listed in Table I. Group IV base oils are polyalphaolefins (PAO). Group V base oils include all other base oils not included in Group I, II, III, or IV. Group III base oils are preferred.

TABLE I

Saturates, Sulfur and Viscosity Index of Group I, II, III, IV and V Base Stocks

| Group | Saturates (As determined by ASTM D2007) Sulfur (As determined by ASTM D2270) | Viscosity Index (As determined by ASTM D4294, ASTM D4297 or ASTM D3120) |
|---|---|---|
| I | Less than 90% saturates and/or Greater than to 0.03% sulfur | Greater than or equal to 80 and less than 120 |

TABLE I-continued

| Saturates, Sulfur and Viscosity Index of Group I, II, III, IV and V Base Stocks | | |
|---|---|---|
| Group | Saturates (As determined by ASTM D2007) Sulfur (As determined by ASTM D2270) | Viscosity Index (As determined by ASTM D4294, ASTM D4297 or ASTM D3120) |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |
| IV | All Polyalphaolefins (PAOs) | |
| V | All others not included in Groups I, II, III, or IV | |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of the present invention. A major amount of base oil as defined herein comprises 40 wt % or more. Preferred amounts of base oil comprise about 40 wt % about 97 wt %, preferably greater than about 50 wt % to about 97 wt %, more preferably about 60 wt % to about 97 wt % and most preferably about 80 wt % to about 95 wt % of the lubricating oil composition. (When weight percent is used herein, it is referring to weight percent of the lubricating oil unless otherwise specified.)

The additive composition of the present invention in the lubricating oil composition will be in a minor amount compared to the base oil of lubricating viscosity. Generally, it will be in an amount from about 1 to 15 wt %, preferably from about 2 to 12 wt % and more preferably from about 3 to 8 wt % based on the total weight of the lubricating oil composition.

In one embodiment, the lubricating oil composition of the present invention will be a low emission diesel lubricant or LEDL having low levels of ash, sulfur and phosphorus. LEDL are particularly desirable for use in low emission diesel engines equipped with exhaust gas after-treatment systems that can be sensitive to lubricant constituents. The LEDL of the present invention will have from about 0 wt % to 1.2 wt % ash, from about 0.1 wt % to 0.5 wt % sulfur, and from about 0.002 wt % to 0.1 wt % phosphorus. Among other things, the LEDL of the present invention provides low temperature viscosity, corrosion and detergent properties while at the same time providing compatibility with exhaust gas after-treatment systems.

The LEDL of the present invention may have, for example, the following composition:

a) a major amount of a base oil of lubricating viscosity; from about 1 wt % to 15 wt % of an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume,
b) from about 1 wt % to 12 wt % of at least one dispersant,
c) from about 0.5 wt % to 1.1 wt % of at least one zinc dithiophosphate,
d) from about 0 wt % to 2.5 wt % of at least one oxidation inhibitor,
e) from about 0 wt % to 1 wt % of at least one foam inhibitor, f) from about 0 wt % to 10 wt % of at least one viscosity index improver, and g) from about 0 wt % to 0.5 wt % of a corrosion inhibitor, having from about 0.05 wt % to 0.5 wt % sulfur, from about 0.1 wt % to 0.5 wt % ash and from about 0.02 wt % to 0.1 wt % phosphorus.

The LEDL of the present invention is produced by the method of blending a mixture of the above components. The LEDL produced by that method might have a slightly different composition than the initial mixture, because the components may interact. The components can be blended in any order and can be blended as combinations of components.

Other Additive Components

The following additive components are examples of components that can be favorably employed in combination with the lubricating additive of the present invention. These examples of additives are provided to illustrate the present invention, but they are not intended to limit it.

(A) Ashless Dispersants: alkenyl succinimides, alkenyl succinimides modified with other organic compounds, and alkenyl succinimides modified with boric acid, alkenyl succinic ester.

(B) Oxidation Inhibitors:

1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis (4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4(N,N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyldithiocarbamate).

(C) Rust Inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethyleneoxide, polyoxyethylene alkyl ether, and polyoxyethylene sorbitane ester.

(E) Extreme Pressure Agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(F) Friction Modifiers: fatty alcohol, fatty acid, amine, borated ester, and other esters (G) Multifunctional Additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound (H) Viscosity Index Improvers: polymethacrylate type polymers, ethylene-propylene copolymers, styrene-isoprene copolymers, hydrated styrene-isoprene copolymers, polyisobutylene, and dispersant type viscosity index improvers.

(I) Pour-point Depressants: polymethyl methacrylate.

(K) Foam Inhibitors: alkyl methacrylate polymers and dimethyl silicone polymers.

(L) Metal Detergents: sulfurized or unsulfurized alkyl or alkenyl phenates, alkyl or alkenyl aromatic sulfonates, calcium sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, and chemical and physical mixtures thereof.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Unless otherwise specified, all percentages are in weight percent (wt %).

Example 1

Preparation of the Additive Composition a) Neutralization

A charge of 875 grams (g) of branched dodecylphenol (DDP) having a molecular weight of 270 (3.24 moles) and 875 g of linear alkylphenol having a molecular weight of 430 (2.03 moles) was loaded in a four-necked 4 liter glass reactor equipped with a heat insulated Vigreux fractionating column. The isomeric molar repartition of para versus ortho alkylphenol was:

DDP=89% para and 5.5% ortho

Linear alkylphenol=39% para and 53% ortho

The agitator was started and the reaction mixture was heated to 65° C. before 162 grams of slaked lime: $Ca(OH)_2$ (2.19 moles) and 19 g of a mixture of formic acid and acetic acid (50/50 by weight) were added.

The reaction medium was heated up to 165° C. Distillation of water started at this temperature. The temperature was increased up to 240° C. and the pressure was reduced gradually below atmospheric until an absolute pressure of 5000 Pa (50 mbars) was obtained. The reaction mixture was kept under these conditions for five hours.

The reaction mixture was then allowed to cool to 180° C., when the vacuum was broken under a nitrogen atmosphere and a sample was taken for analyses. The total distillate obtained was about 120 $cm^3$, demixing took place in the lower phase (66 $cm^3$ being water).

b) Carboxylation

The product obtained in step a) was transferred to a 3.6 liter autoclave and heated to 180° C. At this temperature, scavenging of the reactor with carbon dioxide ($CO_2$) was started and continued for ten minutes. The amount of $CO_2$ used in this step was in the order of 20 g.

After the temperature had reached 200° C., the autoclave was closed, leaving a very small leak and the introduction of $CO_2$ was continued so as to maintain a pressure of $3.5\times10^5$ Pa (3.5 bars) for 5 hours at 200° C. The amount of $CO_2$ introduced was approximately 50 g. After the autoclave had been cooled to 165° C., the pressure was restored to atmospheric and the reactor was then purged with nitrogen. A total quantity of 1,917 g of product was recovered prior to filtration.

c) Filtration

The product from step b) was then filtered. Analytical results for this product were as follows:

TBN=120 mg KOH/g

Calcium=4.1 wt %

Salicylic acid index (SAI)=40 mg KOH/g

SAI is a measure of the quantity of alkyl carboxylate (salicylate) formed in the detergent-dispersant. It was determined by acidification of the product by a strong acid (hydrochloric acid) in the presence of diethyl ether, followed by a potentiometric titration on the organic fraction (tetra-n-butyl ammonium hydroxide was used as a titration agent). Results are expressed in equivalent mg KOH per g of product (TBN, base number unit).

The above procedure was scaled up to a 36 $m^3$ reactor and used to prepare the intermediate product. The intermediate product was then separated from any hydrocarbyl phenol as outlined below.

d) Separation (Distillation) of Hydrocarbyl Phenol

The intermediate product from step b) was fed at a rate of 90 kg/h to a wiped film evaporator (WFE) which had a surface of 0.39 $m^2$. The WFE has an external condenser. The hot oil of the jacket was about 270° C. The pressure inside the WFE was 1.3 mbars (130 Pa), the feed temperature to the WFE was 140° C. Final product exiting the WFE was 225° C.

The product which has a TBN of 209 was cooled down to less than 100° C. before diluting with 100N base in order to obtain a TBN of 140. Approximately 47% (by weight) of the feed from the WFE was collected as distillate. Analytical results for the distilled product were as follows:

TBN=140 mg KOH/g

Calcium=5.0 wt %

Salicylic acid index (SAI)=47 mg KOH/g e) Addition of Calcium Stearate

The product (950 g) obtained after separation of hydrocarbyl phenol was loaded in a 5 liter glass reactor, heated up to 60° C. then 15 g of 2-ethylhexanol and 50 g calcium stearate (5 wt %, based on the total additive composition) were added under agitation.

The reactor was heated up to 170° C. and maintained for 4 hours until the complete integration of calcium stearate. During the last hour, the reactor was stripped with nitrogen at a flow rate of 20 L/h. After which, the reactor was cooled down to ambient temperature. The additive composition obtained was an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume. Analytical results for the distilled products were as follows:

TBN=146 mg KOH/g

Calcium=5.18 wt %

Viscosity at 100° C.=111 $mm^2/s$

Sediments=0.08% volume

Example 2

Addition of Calcium Stearate Generated "In Situ"

In a 5 liter glass reactor was loaded the following premix: 250 g (1.92 moles) 2-ethylhexanol, 46 g (0.16 moles) stearic acid, 12 g water, 12.5 g (0.24 moles) formic acid/acetic acid (50/50 by weight) and 18 g (0.24 moles) slaked lime. The loaded reactor was placed under vacuum, heated up to 100° C. over a period of 15 minutes and maintain for one hour at 100° C. Temperature was raised to 120° C. and maintained a period of one hour while the pressure was gradually reduced below atmospheric until an absolute pressure of 10,000 Pa (100 mbars) was obtained.

The vacuum was gradually broken with nitrogen and 912 g of the product obtained in Example 1 from the end of step d) was added. The mixture was heated to 172° C. over a period of 10 minutes and maintained for one hour at 172° C. About 49 g of calcium stearate was generated in situ, or about 5.1 wt %, based on the total additive composition. The mixture was further heated to 195° C. over a period of 60 minutes while the pressure was reduced gradually below atmospheric until an absolute pressure of 5,000 Pa (50 mbars) was obtained and maintained for 45 minutes at these conditions. The vacuum was broken with nitrogen and the mixture was cooled down to ambient temperature. The analytical results of the unsulfurized carboxylate detergent-dispersant were as follows:

TBN=147 mg KOH/g

Calcium=5.23 wt %

Viscosity at 100° C.=91 $mm^2/s$

Sediments=0.06% volume

Example 3

Example 3 was carried out according to Example 1 except a lower quantity of calcium stearate was added, i.e., 45 g instead of 50 g.

950 g of the product obtained after separation of hydrocarbyl phenol was loaded in a 5 liter glass reactor, heated up to 60° C. then 15 g of 2-ethylhexanol and 45 g (versus 50 g as in Example 1) of calcium stearate were added under agitation. This corresponds to about 4.5 wt %, based on the total additive composition. The batch procedure was the same as Example 1.

Analytical results for the distilled product were as follows:

TBN=144 mg KOH/g

Calcium=5.14 wt %

Viscosity at 100° C.=98 $mm^2/s$

Sediments=0.06% volume

Comparative Example A

This example follows the procedure of Example 1 except the addition of calcium stearate and 2-ethylhexanol was omitted. That is, there was no step e). The analytical results were as follows:

TBN=140 mg KOH/g

Calcium=5.0 wt %

Viscosity at 100° C.=70 $mm^2/s$

Sediments=0.02% volume

Comparative Example B

This example follows the procedure of Example 1 except the addition of calcium stearate in step e) was omitted. 985 g of product of Example 1 from the end of step d) and 15 g 2-ethylhexanol were added in step e). The analytical results are as follows:

TBN=138 mg KOH/g
Calcium=4.92 wt %
Viscosity at 100° C.=50 $mm^2/s$
Sediments=0.02% volume Comparative Example C This example follows the procedure of Example 1 except the addition of 2-ethylhexanol in step e) was omitted. 984 g of product of Example 1 from the end of step d) and 46 g calcium stearate were added in step e). The analytical results are as follows:

TBN=141 mg KOH/g
Calcium=5.03 wt %
Viscosity at 100° C.=190 $mm^2/s$
Sediments=0.25% volume A higher sediment is observed due to a poor dispersion of calcium stearate.

Comparative Example D

This example follows the procedure of Example 1 except a lower quantity of calcium stearate (25 g instead of 46 g) was utilized. This corresponds to about 2.56%, based on the total additive composition. The analytical results are as follows:

TBN=139 mg KOH/g
Calcium=4.96 wt %
Viscosity at 100° C.=105 $mm^2/s$
Sediments=0.02% volume Comparative Example E This example follows the procedure of Example 1 except the 50 g calcium stearate was substituted by 50 g calcium oleate. The analytical results are as follows:

TBN=140 mg KOH/g
Calcium=5.0 wt %
Viscosity at 100° C.=120 $mm^2/s$
Sediments=0.03% volume Comparative Example F This example follows the procedure of Example 1 except 50 g calcium stearate was substituted by 50 g iso-stearate. The analytical results are as follows:

TBN=140 mg KOH/g
Calcium=5.0 wt %
Viscosity at 100° C.=101 $mm^2/s$
Sediments=0.02% volume Comparative Example G Example G was carried out as described in Example 1 except a higher quantity of calcium stearate is added, i.e., 95 g instead of 50 g calcium stearate. This corresponds to about 9 wt %, based on the total additive composition.

950 g of the product obtained after separation of hydrocarbyl phenol was loaded in a 5 liter glass reactor, heated up to 60° C., then 15 g of 2-ethylhexanol and 95 g (versus 50 g as in Example 1) were added under agitation. The batch procedure was the same as in Example 1.

Analytical results for the distilled products were as follows:

TBN=148 mg KOH/g
Calcium=5.30 wt %
Viscosity=205 $mm^2/s$
Sediments=0.25% volume The higher amount of calcium stearate at about 9 wt % creates sediment and solubility problems in the lubricating oil formulations due to the incomplete dispersion of calcium stearate.

Comparative Example H

The additive composition of the present invention was compared to a known carboxylate detergent-dispersant described in Example 1 of U.S. Pat. No. 6,348,438 to illustrate the performance differences between two carboxylates having different TBN and superalkalinization ratios. The carboxylate detergent-dispersant in Example 1 of U.S. Pat. No. 6,348,348 has a high TBN value (348) that means a high level of superalkalinization. i.e., salt/soap ratio is 1.63. The TBN and superalkalinization ratio of the additive composition of the present invention is less than about 200 and less than about 1.4:1, respectively.

Example 4

Lubricating oil formulations (Formulations 1, 2 and 3) were prepared with the products of Examples 1, 2 and 3 as shown in Table II. Each formulation contained the following base composition:

| | |
|---|---|
| Polybutene bissuccinimide | 8.0 wt % |
| Zinc dithiophosphate | 0.69 wt % |
| Calcium sulfonate | 1.36 wt % |
| Oxidation inhibitor | 0.70 wt % |
| Polymer dispersant | 2.0 wt % |
| Anti-foam agent | 0.0025 wt % |
| Viscosity index improver | 6.0 wt % |
| Group III base oil | Sufficient to provide 100 wt % |

The additive composition from Examples 1, 2 and 3 were added according to the wt % indicated in Table II. Each formulation was examined in the ASTM D4684 MRV (Mini Rotary Viscometer), MAO 73 Panel Coker, ASTM D6594 HTCBT (High Temperature Corrosion Bench Test) and MAO 23 Compatibility Tests. These tests are further described below.

The ASTM D4684 MRV test covers the measurement of the yield stress ($0<Y<35$ max) and viscosity (60,000 cp max) of engine oils after cooling at controlled rates over a period not exceeding 45 h to a final test temperature between −10 and −40° C. In the MRV test an engine oil sample is held at 80° C. and then cooled at a programmed cooling rate to a final test temperature. A low torque is applied to the rotor shaft to measure the yield stress. A higher torque is then applied to determine the apparent viscosity of the sample. The viscosity measurements are made at shear stress of 525 Pa over a shear rate of 0.4 to 15 $s^{-1}$.

The MAO 73 Panel Coker test evaluates the tendency of the lubricant to form carbon deposits when in contact with metallic surfaces at high temperature. An oil sample is preheated in a sump (170° C.) and then intermittently projected (by the mean of a rotating oil stirrer) on an aluminum test plate heated at high temperature (300° C.) for a period of 48 h. The amount of deposit is weighed at the end of test. The lower the number, the better the result. Excellent results means less than 50 mg of deposit; poor results means more than 200 mg of deposit.

The ASTM D6594 HTCBT test is used to test diesel engine lubricants to determine their tendency to corrode various metals, specifically alloys of lead and copper commonly used in cam followers and bearings. Four metal specimens of copper, lead, tin and phosphor bronze are immersed in a measured amount of engine oil. The oil, at an elevated temperature (170° C.), is blown with air (5 l/h) for a period of time (168 h). When the test is completed, the copper specimen and the stressed oil are examined to detect corrosion and corrosion products, respectively. The concentrations of copper, lead, and tin in the new oil and stressed oil and the respective changes in metal concentrations are reported. To be a pass the concentration of lead should not exceed 120 ppm and the copper 20 ppm.

The ASTM D97 Pour-point Test is used to determine the minimum of temperature at which the oil remains fluid. After preliminary heating, the sample is cooled at a specified rate and examined at intervals of 3° C. for flow characteristics. The lowest temperature at which movement of the specimen is observed is recorded as the pour-point. The pour-point of the petroleum specimen is an index of the lowest temperature of its utility for certain applications.

The MAO 23 Compatibility Test is used to evaluate the storage stability of lubricating oils. The formulated oil is placed in an oven at 80° C. for a period of a month, then the appearance and the sediment are rated after a month comparatively to standard samples. The ratings are as follows:

Appearance: clear and bright (1), cloud (3), very cloud (6)

Sediment: no sediment (0), light (1), medium (2), high (3)

Rating 1/0 means: appearance clear and bright (1)/no sediment (0)

The lower the rating of the appearance and the lower the rating of the sediment, the better the product. A good result is an appearance rating of 2 max and a sediment rating of 1 max.

The results of these tests are presented in Table II.

Comparative Example I

Comparative lubricating oil formulations (Formulations A to H) were prepared with the products of Comparative Examples A to H as shown in Table III. Each formulation contained the following base composition:

| | |
|---|---|
| Polybutene bissuccinimide | 8.0 wt % |
| Zinc dithiophosphate | 0.69 wt % |
| Calcium sulfonate | 1.36 wt % |
| Oxidation inhibitor | 0.70 wt % |
| Polymer dispersant | 2.0 wt % |
| Anti-foam agent | 0.0025 wt % |
| Viscosity index improver | 6.0 wt % |
| Group III base oil | Sufficient to provide 100 wt % |

Comparative Examples A to H were added according to the wt % indicated in Table Ill. Each formulation was examined in the ASTM D4684 MRV (Mini Rotary Viscometer), MAO 73 Panel Coker, ASTM D6594 HTCBT (High Temperature Corrosion Bench Test) and MAO 23 Compatibility Tests. These tests are described in Example 4 above.

TABLE II

| | Examples[a] | | |
|---|---|---|---|
| Component | 1 | 2 | 3 |
| Polybutene Bissuccinimide | 8% | 8% | 8% |
| Zinc Dithiophosphate | 0.69% | 0.69% | 0.69% |
| Calcium Sulfonate | 1.36% | 1.36% | 1.36% |
| Oxidation Inhibitor | 0.70% | 0.70% | 0.70% |
| Polymer Dispersant | 2% | 2% | 2% |
| Product of Invention[b] | 4.48% | 4.44% | 4.51% |
| Anti-Foam Agent | 0.0025% | 0.0025% | 0.0025% |
| Viscosity Index Improver | 6.00% | 6.00% | 6.00% |
| Base Oil/Group III (Fortum + Total) | QSP 100 | QSP 100 | QSP 100 |
| Performance Analyses | Base Oil/Group III (Nexbase 3060 Total) | | |
| MRV Yield Stress ASTM D4684 | 0 < Y <= 35 | 0 < Y <= 35 | 0 < Y <= 35 |
| MRV Viscosity ASTM D4684 | 42910 | 42910 | 46000 |
| Panel Coker MAO 73 (mg) | 30 | 30 | 30 |
| HCTBT ASTM D6594 | | | |
| Copper in oil (ppm) | 5 | 4 | 5 |
| Lead in oil (ppm) | 80 | 81 | 79 |
| Pour-point ASTM D 97 (° C.) | −33 | −33 | −33 |
| Compatibility MAO 23 | 1/0 | 1/0 | 1/0 |

[a]% are wt %.

[b]Unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

TABLE III

| | Comparative Examples[a] | | | | | | | |
|---|---|---|---|---|---|---|---|---|
| Component | A | B | C | D | E | F | G | H |
| Polybutene Bissuccinimide | 8% | 8% | 8% | 8% | 8% | 8% | 8% | 8% |
| Zinc Dithiophosphate | 0.69% | 0.69% | 0.69% | 0.69% | 0.69% | 0.69% | 0.69% | 0.69% |

TABLE III-continued

| Component | Comparative Examples[a] | | | | | | | |
|---|---|---|---|---|---|---|---|---|
| | A | B | C | D | E | F | G | H |
| Calcium Sulfonate | 1.36% | 1.36% | 1.36% | 1.36% | 1.36% | 1.36% | 1.36% | 1.36% |
| Oxidation Inhibitor | 0.70% | 0.70% | 0.70% | 0.70% | 0.70% | 0.70% | 0.70% | 0.70% |
| Polymer Dispersant | 2.00% | 2.00% | 2.00% | 2.00% | 2.00% | 2.00% | 2.00% | 2.00% |
| Carboxylate | 4.49% | 4.60% | 4.35% | 4.54% | 6.07% | 6.22% | 4.23% | 1.87% |
| Anti-Foam Agent | 0.0025% | 0.0025% | 0.0025% | 0.0025% | 0.0025% | 0.0025% | 0.0025% | 0.0025% |
| Viscosity Index Improver | 6.00% | 6.00% | 6.00% | 6.00% | 6.00% | 6.00% | 6.00% | 6.00% |
| Base Oil/Group III (Fortum + Total) | QSP 100% | QSP 100% | QSP 100% | QSP 100% | QSP 100% | QSP 100% | QSP 100% | QSP 100% |
| Performance Analyses | Base Oil/Group III (Nexbase 3060 Total) | | | | | | | |
| MRV Yield Stress ASTM D4684 | >350 | >350 | 70 < Y <= 105 | >350 | >350 | >350 | 0 < Y <= 35 | 0 < Y <= 35 |
| MRV Viscosity ASTM D4684 | Frozen | Frozen | 84485 | Frozen | Frozen | Frozen | 21000 | 22500 |
| Panel Coker MAO 73 (mg) | 30 | 25 | 30 | 25 | 25 | 30 | 30 | 305 |
| HTCBT ASTM D6594 | | | | | | | | |
| Copper in oil (ppm) | 5 | 5 | 4 | 5 | 5 | 4 | 6 | 6 |
| Lead in (ppm) | 78 | 77 | 79 | 79 | 78 | 78 | 82 | 81 |
| Pour-point ASTM D97 (° C.) | −24 | −24 | −27 | −27 | −24 | −24 | −33 | −33 |
| Compatibility MAO 23 | 1/0 | 1/0 | 3/2 | 1/0 | 1.0 | 1/0 | 6/2 | 1/0 |

[a]% are wt %.

The results of the above data indicate that the additive composition of the present invention comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume provides excellent low temperature viscosity as well as corrosion and detergency properties when compared to lubricating oil formulations without the additive composition of the present invention. The results indicate that having a high TBN, too low or too high a superalkalinization ratio, and too high a sediment value will not give the good low temperature viscosity, corrosion and detergent properties. Finally, the present invention is unique to a certain alkaline earth metal salt of a linear, saturated carboxylic acid, i.e. calcium stearate. Alkaline earth metal salt of carboxylic acids having unsaturation (calcium oleate) or branching (calcium iso-stearate) were inferior toward contributing to the good low temperature viscosity, corrosion and detergent properties. Moreover, the addition of alkaline earth metal salt of the linear, saturated carboxylic acid must occur in the presence of a solvent for the proper incorporation of the carboxylic acid into the unsulfurized carboxylic detergent-dispersant additive.

What is claimed is:

1. An additive composition comprising an unsulfurized carboxylate detergent-dispersant additive having been modified by incorporation, in the presence of a solvent, of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

2. The additive composition according to claim 1, wherein the unsulfurized carboxylate detergent-dispersant additive comprises: a) less than about 30 wt % hydrocarbyl phenol, b) from about 10 wt % to 50 wt % alkaline earth metal hydrocarbyl phenate, and c) from about 15 wt % to 60 wt % alkaline earth metal single aromatic-ring hydrocarbyl salicylate.

3. The additive composition according to claim 2, wherein the hydrocarbyl group on the hydrocarbyl phenol, hydrocarbyl phenate and hydrocarbyl salicylate is independently derived from a linear olefin, an isomerized olefin, a branched chain olefin or a mixture thereof.

4. The additive composition according to claim 3, wherein the hydrocarbyl group is an alkyl group.

5. The additive composition according to claim 4, wherein the alkyl group has from about 12 to 40 carbon atoms.

6. The additive composition according to claim 5, wherein the alkyl group has from about 18 to 30 carbon atoms.

7. The additive composition according to claim 6, wherein the alkyl group is derived from an isomerized olefin.

8. The additive composition according to claim 4, wherein the alkyl group is a branched alkyl group having at least 9 carbon atoms.

9. The additive composition according to claim 8, wherein the alkyl group is a branched alkyl group having from about 9 to 24 carbon atoms.

10. The additive composition according to claim 9, wherein the alkyl group is a branched alkyl group having from about 10 to 18 carbon atoms.

11. The additive composition according to claim 2, wherein the alkaline earth metal of the alkaline earth metal hydrocarbyl phenate and the alkaline earth metal single aromatic-ring hydrocarbyl salicylate is independently selected from the group consisting of calcium, magnesium, barium, or strontium.

12. The additive composition according to claim 11, wherein the alkaline earth metal of the alkaline earth metal hydrocarbyl phenate and the alkaline earth metal single aromatic-ring hydrocarbyl salicylate is calcium.

13. The additive composition according to claim 1, wherein the alkaline earth metal of the alkaline earth metal salt of the linear, saturated carboxylic acid is calcium.

14. The additive composition according to claim 13, wherein the linear, saturated carboxylic acid is stearic acid.

15. The additive composition according to claim 1, wherein the alkaline earth metal salt of the linear, saturated carboxylic acid is present at a concentration of from about 3.5 wt % to 7.0 wt % based on the total additive composition.

16. The additive composition according to claim 15, wherein the alkaline earth metal salt of linear, saturated carboxylic acid is present at a concentration of from about 4.0 wt % to 6.0 wt % based on the total additive composition.

17. The additive composition according to claim 1, wherein linear, saturated carboxylic acid is stearic acid.

18. The additive composition according to claim 1, wherein the TBN is less than about 160.

19. The additive composition according to claim 1, wherein the TBN is less than about 140.

20. A lubricating oil composition comprising: a) a major amount of base oil of lubricating viscosity; and b) a minor amount of an additive composition comprising an unsulfurized carboxylate detergent-dispersant additive having been modified by incorporation, in the presence of a solvent, of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

21. The lubricating oil composition according to claim 20, wherein the unsulfurized carboxylate detergent-dispersant additive comprises: a) less than about 30 wt % hydrocarbyl phenol, b) from about 10 wt % to 50 wt % alkaline earth metal hydrocarbyl phenate, and c) from about 15 wt % to 60 wt % alkaline earth metal single aromatic-ring hydrocarbyl salicylate.

22. The lubricating oil composition according to claim 21, wherein the hydrocarbyl group on the hydrocarbyl phenol, hydrocarbyl phenate and hydrocarbyl salicylate is independently derived from a linear olefin, an isomerized olefin, a branched chain olefin or a mixture thereof.

23. The lubricating oil composition according to claim 22, wherein the hydrocarbyl group is an alkyl group.

24. The lubricating oil composition according to claim 23, wherein the alkyl group has from about 12 to 40 carbon atoms.

25. The lubricating oil composition according to claim 24, wherein the alkyl group has from about 18 to 30 carbon atoms.

26. The lubricating oil composition according to claim 25, wherein the alkyl group is derived from an isomerized olefin.

27. The lubricating oil composition according to claim 23, wherein the alkyl group is a branched alkyl group having at least 9 carbon atoms.

28. The lubricating oil composition according to claim 27 wherein alkyl group is a branched alkyl group having from about 9 to 24 carbon atoms.

29. The lubricating oil composition according to claim 28, wherein alkyl group is a branched alkyl group having from about 10 to 18 carbon atoms.

30. The lubricating oil composition according to claim 21, wherein the alkaline earth metal of the alkaline earth metal hydrocarbyl phenate and alkaline earth metal single aromatic-ring hydrocarbyl salicylate is independently selected from the group consisting of calcium, magnesium, barium, or strontium.

31. The lubricating oil composition according to claim 30, wherein the alkaline earth metal of the alkaline earth metal hydrocarbyl phenate and the alkaline earth metal single aromatic-ring hydrocarbyl salicylate is calcium.

32. The lubricating oil composition according to claim 20, wherein the alkaline earth metal of the alkaline earth metal salt of linear, saturated carboxylic acid is calcium.

33. The lubricating oil composition according to claim 32, wherein the linear, saturated carboxylic acid is stearic acid.

34. The lubricating oil composition according to claim 20, wherein the alkaline earth metal salt of the linear, saturated carboxylic acid is present at a concentration of from about 3.5 wt % to 7.0 wt % based on the total additive composition.

35. The lubricating oil composition according to claim 34, wherein the alkaline earth metal salt of linear, saturated carboxylic acid is present at a concentration of from about 4.0 wt % to 6.0 wt % based on the total additive composition.

36. The lubricating oil composition according to claim 20, wherein the linear, saturated carboxylic acid is stearic acid.

37. The lubricating oil composition according to claim 20, wherein the TBN of the additive composition is less than about 160.

38. The lubricating oil composition according to claim 20, wherein the TBN of the additive composition is less than about 140.

39. A method for producing an additive composition comprising an unsulfurized carboxylate detergent-dispersant additive having been modified by incorporation of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume, said method comprising: a) neutralizing one or more hydrocarbyl phenols using an alkaline earth metal base to form an intermediate product, b) carboxylating the intermediate product of a) using carbon dioxide so that at least about 5 wt % of the original hydrocarbyl phenol starting material has been converted to alkaline earth single aromatic-ring hydrocarbyl salicylate, c) separating at least about 10 wt % of the starting hydrocarbyl phenols from the product obtained in b), and d) adding an alkaline earth metal salt of a linear, saturated carboxylic acid having from about 16 to about 20 carbon atoms in the presence of a solvent selected from the group consisting of aromatic hydrocarbons, aliphatic hydrocarbons and monoalcohols to produce the additive composition.

40. The method according to claim 39, wherein the unsulfurized carboxylate detergent-dispersant additive comprises: a) less than about 30 wt % hydrocarbyl phenol, b) from about 10 wt % to 50 wt % alkaline earth metal hydrocarbyl phenate, and c) from about 15 wt % to 60 wt % alkaline earth metal single aromatic-ring hydrocarbyl salicylate.

41. The method according to claim 40, wherein the hydrocarbyl group on the hydrocarbyl phenol, hydrocarbyl phenate and hydrocarbyl salicylate is independently derived from a linear olefin, an isomerized olefin, a branched chain olefin or a mixture thereof.

42. The method according to claim 41, wherein the hydrocarbyl group is an alkyl group.

43. The method according to claim 42, wherein the alkyl group has from about 12 to 40 carbon atoms.

44. The method according to claim 43, wherein the alkyl group has from about 18 to 30 carbon atoms.

45. The method according to claim 44, wherein the alkyl group is derived from an isomerized olefin.

46. The method according to claim 42, wherein the alkyl group is a branched alkyl group having at least 9 carbon atoms.

47. The method according to claim 46, wherein the alkyl group is a branched alkyl group having from about 9 to 24 carbon atoms.

48. The method according to claim 47, wherein the alkyl group is a branched alkyl group having from about 10 to 18 carbon atoms.

49. The method according to claim 40, wherein the alkaline earth metal of the alkaline earth metal hydrocarbyl phenate and the alkaline earth metal single aromatic-ring hydrocarbyl salicylate is independently selected from the group consisting of calcium, magnesium, barium, or strontium.

50. The method according to claim 49, wherein the alkaline earth metal of the alkaline earth metal hydrocarbyl phenate and the alkaline earth metal single aromatic-ring hydrocarbyl salicylate is calcium.

51. The method according to claim 39, wherein the alkaline earth metal of the alkaline earth metal salt of linear, saturated carboxylic acid is calcium.

52. The method according to claim 51, wherein the linear, saturated carboxylic acid is stearic acid.

53. The method according to claim 39, wherein the alkaline earth metal salt of the linear, saturated carboxylic acid is a present at a concentration of from about 3.5 wt % to 7.0 wt % based on the total additive composition.

54. The method composition according to claim 53, wherein the alkaline earth metal salt of linear, saturated carboxylic acid is present at a concentration of from about 4.0 wt % to 6.0 wt % based on the total additive composition.

55. The method according to claim 39, wherein linear, saturated carboxylic acid is stearic acid.

56. The method according to claim 39, wherein the TBN of the additive composition is less than about 160.

57. The method according to claim 39, wherein the TBN of the additive composition is less than about 140.

58. The method according to claim 39, wherein the solvent in step d) is 2-ethylhexanol.

59. A product produced according to the method of claim 39.

60. A method of improving low temperature viscosity while maintaining corrosion and detergent properties of a lubricating oil composition in an internal combustion engine, said method comprising operating the internal combustion engine with a lubricating oil composition comprising: a) a major amount of base oil of lubricating viscosity; and b) a minor amount of an additive composition comprising an unsulfurized carboxylate detergent-dispersant additive having been modified by incorporation, in the presence of a solvent, of from about 3.2 wt % to 7.5 wt %, based on the total additive composition, of an alkaline earth metal salt of a linear, saturated carboxylic acid having from about 16 to about 20 carbon atoms and wherein the additive composition has a superalkalinization ratio of less than about 1.4:1, a TBN of less than about 200 and a sediment value of less than about 0.2% by volume.

61. The method according to claim 60, wherein the lubricating oil composition is a low emission diesel lubricant.

62. The additive composition according to claim 1, wherein the superalkalinization ratio is less than about 1:1.

63. The additive composition according to claim 1, wherein the superalkalinization ratio is less than about 0.2 to 1.

64. The lubricating oil composition according to claim 20, wherein the superalkalinization ratio is less than about 1:1.

65. The lubricating oil composition according to claim 20, wherein the superalkalinization ratio is less than about 0.2 to 1.

66. The method according to claim 39, wherein the superalkalinization ratio is less than about 1:1.

67. The method according to claim 39, wherein the superalkalinization ratio is less than about 0.2 to 1.

* * * * *